US010160939B2

(12) United States Patent
Meier et al.

(10) Patent No.: US 10,160,939 B2
(45) Date of Patent: Dec. 25, 2018

(54) LOW-WATER-CONTENT, LIQUID DETERGENT COMPRISING SURFACTANTS OBTAINED FROM RENEWABLE RAW MATERIALS

(71) Applicant: Henkel AG & Co. KGaA, Duesseldorf (DE)

(72) Inventors: Frank Meier, Dusseldorf (DE); Leyla Koelling, Hilden (DE); Luca Bellomi, Duesseldorf (DE); Sabine Schuemann, Neuss (DE); Matthias Sunder, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 14/534,902

(22) Filed: Nov. 6, 2014

(65) Prior Publication Data

US 2015/0065410 A1 Mar. 5, 2015

Related U.S. Application Data

(63) Continuation of application No. PCT/EP2013/059469, filed on May 7, 2013.

(30) Foreign Application Priority Data

May 16, 2012 (DE) ..... 10 2012 208 286

(51) Int. Cl.

| | |
|---|---|
| ***C11D 1/02*** | (2006.01) |
| ***C11D 1/72*** | (2006.01) |
| ***C11D 3/43*** | (2006.01) |
| ***C11D 17/04*** | (2006.01) |
| ***C11D 1/722*** | (2006.01) |
| ***C11D 1/14*** | (2006.01) |
| ***C11D 3/20*** | (2006.01) |
| ***C11D 1/83*** | (2006.01) |
| ***C11D 10/04*** | (2006.01) |
| *C11D 1/04* | (2006.01) |
| *C11D 1/28* | (2006.01) |
| *C11D 1/29* | (2006.01) |
| *C11D 1/66* | (2006.01) |
| *C11D 1/74* | (2006.01) |

(52) U.S. Cl.

CPC ..... *C11D 17/043* (2013.01); *C11D 1/14* (2013.01); *C11D 1/722* (2013.01); *C11D 1/83* (2013.01); *C11D 3/201* (2013.01); *C11D 3/2003* (2013.01); *C11D 3/2044* (2013.01); *C11D 3/43* (2013.01); *C11D 10/04* (2013.01); *C11D 1/04* (2013.01); *C11D 1/146* (2013.01); *C11D 1/28* (2013.01); *C11D 1/29* (2013.01); *C11D 1/662* (2013.01); *C11D 1/72* (2013.01); *C11D 1/74* (2013.01)

(58) Field of Classification Search

CPC .... C11D 1/04; C11D 1/14; C11D 1/29; C11D 1/662; C11D 1/72; C11D 1/722; C11D 1/83; C11D 3/2003; C11D 3/201; C11D 3/2044; C11D 3/43; C11D 17/043

USPC ..... 510/296, 338, 351, 352, 356, 357, 439, 510/481, 488, 505, 506

See application file for complete search history.

(56) References Cited

U.S. PATENT DOCUMENTS

| | | | | |
|---|---|---|---|---|
| 6,815,410 | B2 * | 11/2004 | Boutique | C11D 3/2086 510/295 |
| 7,666,828 | B2 * | 2/2010 | Bernhardt | C07C 303/06 510/495 |
| 7,879,790 | B2 * | 2/2011 | Bernhardt | C07C 303/06 510/495 |
| 8,119,588 | B2 * | 2/2012 | Bernhardt | A01N 25/30 510/495 |
| 2003/0050209 | A1 * | 3/2003 | Perkis | B65B 11/50 510/296 |
| 2003/0199414 | A1 * | 10/2003 | Boutique | C11D 3/2086 510/293 |
| 2009/0312220 | A1 * | 12/2009 | Boutoille | C11D 3/40 510/277 |
| 2010/0016198 | A1 * | 1/2010 | Bernhardt | C07C 303/06 510/127 |
| 2010/0056416 | A1 | 3/2010 | Scheuing et al. | |
| 2010/0305020 | A1 * | 12/2010 | Jennewein | C11D 3/0084 510/513 |
| 2011/0188784 | A1 * | 8/2011 | Denome | B65D 65/46 383/1 |
| 2012/0053103 | A1 * | 3/2012 | Sivik | C11D 17/041 510/218 |

FOREIGN PATENT DOCUMENTS

| | | | |
|---|---|---|---|
| EP | 0656416 | A1 | 6/1995 |
| EP | 2441824 | A1 | 4/2012 |
| WO | 02/057398 | A1 | 7/2002 |

OTHER PUBLICATIONS

PCT International Search Report (PCT/EP2013/059469) dated Oct. 10, 2013.

* cited by examiner

*Primary Examiner* — Gregory R Delcotto
(74) *Attorney, Agent, or Firm* — Thomas G. Krivulka

(57) ABSTRACT

The application describes a water-soluble package which contains a liquid washing or cleaning agent and a water-soluble envelope. The liquid washing or cleaning agent contains a) nonionic surfactant selected from the group consisting of alkoxylated fatty alcohols, alkyl polyglycosides, ethoxylated methyl esters of natural fatty acids and mixtures thereof, b) anionic surfactant selected from the group consisting of fatty alcohol sulfates, fatty alcohol ether sulfates, fatty acid soaps, sulfonated estolides and mixtures thereof, c) organic solvent which comprises a mixture of 1,2-propanediol and ethanol, and d) up to 15 wt. %, relative to the entire washing or cleaning agent, of water.

5 Claims, No Drawings

LOW-WATER-CONTENT, LIQUID DETERGENT COMPRISING SURFACTANTS OBTAINED FROM RENEWABLE RAW MATERIALS

FIELD OF THE INVENTION

The present invention generally relates to a water-soluble package comprising a water-soluble envelope and a liquid washing or cleaning agent with anionic and nonionic surfactants.

BACKGROUND OF THE INVENTION

Conventional commercial washing or cleaning agents usually contain combinations of a plurality of surfactants in order to meet the requirements placed on the agent with regard to washing and cleaning performance. The surfactants are here conventionally both those which are obtained from renewable raw materials, such as for example ethoxylated fatty alcohols, fatty alcohol sulfates, fatty alcohol ether sulfates or alkyl polyglycosides and those which are obtained from petrochemicals, such as in particular alkylbenzenesulfonates. In the light of increasing levels of environmental consciousness in industry and among consumers, however, it is desirable to formulate a washing or cleaning agent which is as climate-neutral as possible, which can be achieved by using surfactants obtained from renewable raw materials.

Today, washing or cleaning agents are offered for sale to consumers in many and varied presentations. In addition to powders and granules, these presentations for example also include liquids, gels or portion packages (tablets or filled pouches).

Portion packages containing liquid washing or cleaning agents are in particular becoming ever more popular, since on the one hand they fulfill the consumer's desire for simplified dispensing and on the other hand an ever increasing number of consumers prefer liquid washing or cleaning agents.

When formulating liquid washing or cleaning agents for packaging in water-soluble pouches care must in particular be taken to ensure that the ingredients of the washing or cleaning agent do not partially or completely dissolve the water-soluble envelope of the pouch before use thereof and so give rise to unwanted leaks.

One ingredient which can destroy the structural integrity of the water-soluble envelope of a pouch is water. It is for this reason that liquid washing or cleaning agents for packaging in water-soluble pouches have the lowest possible content of water.

WO 2002/057398 A1, for example, discloses a water-soluble container containing a liquid detergent composition comprising: a) an alkylbenzenesulfonic acid neutralized with an alkanolamine, b) an organic solvent and c) less than 3 wt. % of water.

Alkylbenzenesulfonates are preferably used in washing or cleaning agents with a low water content not only because of their good washing and cleaning performance, but also because they can be used in highly concentrated form, i.e. in a form with a low water content. This means that using alkylbenzenesulfonates as anionic surfactant results in the liquid washing or cleaning agents having a low water content. Other anionic surfactants, such as for example fatty alcohol ether sulfates already contain elevated quantities (>25%) of water in the raw material.

There is thus a requirement to provide washing or cleaning agents packaged in water-soluble envelopes, which agents solely contain surfactants which are obtained from renewable raw materials.

It was accordingly an object of the present invention to provide stable washing or cleaning agents packaged in water-soluble envelopes, which agents solely contain surfactants which are obtained from renewable raw materials.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A water-soluble package which contains a liquid washing or cleaning agent and a water-soluble envelope, wherein the liquid washing or cleaning agent contains a) nonionic surfactant selected from the group consisting of alkoxylated fatty alcohols, alkyl polyglycosides, ethoxylated methyl esters of natural fatty acids and mixtures thereof; b) anionic surfactants selected from the group consisting of fatty alcohol sulfates, fatty alcohol ether sulfates, fatty acid soaps, sulfonated estolides and mixtures thereof; c) organic solvent which comprises a mixture of 1,2-propanediol and ethanol; and d) up to 15 wt. %, relative to the entire washing or cleaning agent, of water.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the present invention is achieved by a water-soluble package which contains a liquid washing or cleaning agent and a water-soluble envelope, wherein the liquid washing or cleaning agent contains a) nonionic surfactant selected from the group consisting of alkoxylated fatty alcohols, alkyl polyglycosides, ethoxylated methyl esters of natural fatty acids and mixtures thereof,
b) anionic surfactants selected from the group consisting of fatty alcohol sulfates, fatty alcohol ether sulfates, fatty acid soaps, sulfonated estolides and mixtures thereof,
c) organic solvent which comprises a mixture of 1,2-propanediol and ethanol, and
d) up to 15 wt. %, relative to the entire washing or cleaning agent, of water.

It has surprisingly been found that, with the assistance of the selected surfactant system and the selected solvent system, it is possible to obtain a stable water-soluble package containing a liquid washing or cleaning agent solely comprising surfactants obtained from renewable raw materials. Other solvent systems result in sedimentation and/or syneresis.

The ionic strength $I_c$ of the washing or cleaning agent is preferably less than 250 mmol/l. It has been found that such an ionic strength prevents ingredients, in particular surfactants, of the liquid washing or cleaning agent from being salted out and deposited on the interior surface of the water-soluble envelope.

The washing or cleaning agent has particularly good cleaning performance and good foaming behavior if the anionic surfactant is a mixture of fatty alcohol ether sulfate and fatty acid soap.

It is furthermore preferred for the quantity of fatty alcohol ether sulfate in the liquid washing or cleaning agent to amount to at least 5 wt. %.

It is moreover preferred for the washing or cleaning agent to have a water activity $a_w$ of ≥0.38.

In a preferred embodiment of the invention, the quantity of aerobically non-biodegradable organic (aNBO) ingredients in the washing or cleaning agent amounts to less than 0.55 g per kg of laundry load.

In a further embodiment of the invention, the quantity of anaerobically non-biodegradable organic (anNBO) ingredients in the washing or cleaning agent amounts to less than 0.70 g per kg of laundry load.

It is preferred for the water-soluble envelope to contain polyvinyl alcohol or a polyvinyl alcohol copolymer. Water-soluble envelopes which contain polyvinyl alcohol or a polyvinyl alcohol copolymer have good stability combined with a sufficiently high water solubility, in particular cold water solubility.

The invention will be explained in greater detail below, inter alia with reference to examples.

The application relates to a water-soluble package which contains a liquid washing or cleaning agent and a water-soluble envelope.

The water-soluble package contains a water-soluble envelope which forms a closed structure which, in the interior thereof, has one or more chambers for accommodating one or more washing or cleaning agents.

The water-soluble package may be made dimensionally stable or deformable.

The water-soluble package may assume dimensionally stable form, for example the form of a capsule, box, pot or container.

However, it is in principle also possible and preferable to shape the water-soluble package as a non-dimensionally stable container, for example as a pouch. The shape of such a water-soluble package may be extensively adapted to the circumstances of use. The most varied shapes such as for example tubes, cushions, cylinders, bottles or discs may be considered.

The water-soluble package contains a liquid washing or cleaning agent. The liquid washing or cleaning agent solely contains surfactants which are obtained from renewable raw materials.

The liquid washing or cleaning agent contains a nonionic surfactant selected from the group consisting of alkoxylated fatty alcohols, alkyl polyglycosides, ethoxylated methyl esters of natural fatty acids and mixtures thereof.

Preferably used alkoxylated fatty alcohols are ethoxylated, in particular primary alcohols with preferably 8 to 18 C atoms and on average 4 to 12 mol of ethylene oxide (EO) per mol of alcohol, in which the alcohol residue is linear. In particular, alcohol ethoxylates with 12 to 18 C atoms, for example prepared from coconut, palm, tallow fat or oleyl alcohol, and on average 5 to 8 EO per mol of alcohol are preferred. Preferred ethoxylated alcohols include, for example, $C_{12-14}$ alcohols with 4 EO or 7 EO, $C_{9-11}$ alcohol with 7 EO, $C_{12-18}$ alcohols with 5 EO or 7 EO and mixtures of these. The stated degrees of ethoxylation are statistical averages which, for a specific product, may be an integer or a fractional number. Preferred alcohol ethoxylates have a narrow homologue distribution (narrow range ethoxylates, NRE). In addition or alternatively to these alkoxylated fatty alcohols, it is also possible to use fatty alcohols with more than 12 EO. Examples of these are tallow fatty alcohol with 14 EO, 25 EO, 30 EO or 40 EO. Alkoxylated fatty alcohols containing EO and PO groups together in one molecule may also be used according to the invention.

Alkyl glycosides of the general formula $RO(G)_x$, in which R means a primary straight-chain or methyl-branched aliphatic residue, in particular methyl-branched in position 2, with 8 to 22, preferably 12 to 18 C atoms and G is the symbol which denotes a glycose unit with 5 or 6 C atoms, preferably glucose, may moreover also be used as further nonionic surfactants. The degree of oligomerization x, which indicates the distribution of monoglycosides and oligoglycosides, is any desired number between 1 and 10; x is preferably 1.2 to 1.4.

Further suitable nonionic surfactants are ethoxylated methyl esters of natural fatty acids, such as for example coconut, palm kernel or olive oil fatty acids, with preferably 8 to 18 EO units.

The liquid washing or cleaning agent preferably solely contains alkoxylated fatty alcohols as nonionic surfactants.

The total quantity of nonionic surfactant in the liquid washing or cleaning agent amounts to up to 45 wt. %, preferably 15 to 40 wt. % and more preferably 20 to 30 wt. %, relative to the entire liquid washing or cleaning agent.

The liquid washing or cleaning agent furthermore contains an anionic surfactant selected from the group consisting of fatty alcohol sulfates, fatty alcohol ether sulfates, fatty acid soaps, sulfonated estolides and mixtures thereof. More preferably, the liquid washing or cleaning agent contains fatty alcohol ether sulfates and/or fatty acid soaps as anionic surfactant. Particularly preferably, the anionic surfactant contains a mixture of fatty alcohol ether sulfates and fatty acid soaps and contains no further anionic surfactants.

Preferred fatty alcohol sulfates are the salts of sulfuric acid semiesters of $C_{12}$-$C_{18}$ fatty alcohols, for example obtained from coco fatty alcohol, tallow fatty alcohol, lauryl, myristyl, cetyl or stearyl alcohol. $C_{12}$-$C_{16}$ alkyl sulfates and $C_{12}$-$C_{15}$ alkyl sulfates as well as $C_{14}$-$C_{15}$ alkyl sulfates are preferred because of their washing characteristics.

The sulfuric acid monoesters of straight-chain or branched $C_{7-21}$ alcohols ethoxylated with 1 to 6 mol of ethylene oxide, such as 2-methyl-branched $C_{9-11}$ alcohols with on average 3.5 mol of ethylene oxide (EO) or $C_{12-18}$ fatty alcohols with 1 to 4 EO are for example used as fatty alcohol ether sulfates.

Fatty acid soaps are further suitable anionic surfactants. Saturated and unsaturated fatty acid soaps are in particular suitable, such as the salts of lauric acid, myristic acid, palmitic acid, stearic acid, (hydrogenated) erucic acid and behenic acid and in particular soap mixtures derived from natural fatty acids, for example coconut, palm kernel, olive oil or tallow fatty acids.

The anionic surfactants, including the fatty acid soaps, may be present in the form of the sodium, potassium or ammonium salts thereof. The anionic surfactants are preferably present in the form of the sodium or ammonium salts thereof. The ammonium salts may be the salts of organic bases. The amine used for neutralization is preferably choline, triethylamine, monoethanolamine, diethanolamine, triethanolamine, methylethylamine or a mixture thereof, wherein monoethanolamine is preferred.

Suitable sulfonated estolides comprise compounds of the following formula

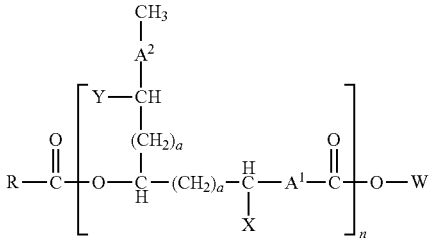

wherein n is an integer from 1 to 30, one of X or Y is $SO_3$—Z and the other is hydrogen, wherein X and Y are present in each repeat unit, $A^1$ and $A^2$ are linear or branched, saturated or unsaturated, substituted or unsubstituted $C_8$-$C_{22}$ alkylene units, a in each repeat unit is independently 0, 1, or 2, R is a linear or branched, saturated or unsaturated, substituted or unsubstituted $C_1$-$C_{24}$ alkyl unit, W is a monovalent or divalent metal cation, an ammonium cation, a substituted ammonium cation, hydrogen, an alkyl group or a substituted alkyl group and Z is hydrogen, a monovalent or divalent metal cation, an ammonium cation or substituted ammonium cation.

In a particularly preferred embodiment, the liquid washing or cleaning agent contains the sodium salt of a fatty alcohol ether sulfate and a fatty acid neutralized with monoethanolamine. It is also preferred for the quantity of fatty alcohol ether sulfate in the entire liquid washing or cleaning agent to amount to at least 5 wt. %.

The total quantity of anionic surfactant in the liquid washing or cleaning agent amounts to up to 35 wt. % and preferably 15 to 30 wt. %, relative to the entire liquid washing or cleaning agent.

The total quantity of nonionic and anionic surfactant in the liquid washing or cleaning agent amounts to up to 75 wt. % and preferably 50 to 60 wt. %, relative to the entire liquid washing or cleaning agent.

The liquid washing or cleaning agent furthermore contains organic solvent which comprises a mixture of 1,2-propanediol and ethanol.

The quantity of ethanol here amounts to up to 5 wt. % and preferably between 1 and 3 wt. %, in each case relative to the entire washing or cleaning agent.

The quantity of 1,2-propanediol amounts to up to 50 wt. %, preferably between 10 and 40 wt. %, and particularly preferably between 20 and 35 wt. %, in each case relative to the entire washing or cleaning agent.

It has in particular been found that liquid washing or cleaning agents which have another organic solvent system, for example a mixture of 1,2-propanediol and isopropanol, are unstable.

In a more preferred embodiment, the liquid washing or cleaning agent therefore contains no isopropanol and in a particularly preferred embodiment contains no further organic solvents. A more preferred liquid washing or cleaning agent accordingly contains an organic solvent which is a mixture of 1,2-propanediol and ethanol.

The washing or cleaning agent may contain water, wherein the water content amounts to less than 15 wt. % and more preferably less than 13 wt. %, in each case relative to the total liquid washing or cleaning agent. More preferably, the entire liquid washing or cleaning agent contains 7 to 12 wt. % water.

The liquid washing or cleaning agent preferably has a water activity $a_w$ of greater than 0.38 and more preferably of greater than 0.42. Water activity is determined at 25° C. using an "AquaLab Lite" instrument from IUL Instruments GmbH.

Water activity $a_w$ is a measure of the freely available water in a material and indicates the availability of the water for chemical, biochemical and microbial reactions. Water activity is stated as an $a_w$ value and is defined as the quotient of the concentration of water in the vapor phase in the airspace over the material and the water concentration in the airspace over pure water at a specific temperature:

$$a_w = \frac{p}{p_0}$$

In addition to the nonionic surfactant, the anionic surfactant and the organic solvent, the washing or cleaning agent may contain further ingredients which further improve the applicational and/or esthetic properties of the washing or cleaning agent, but do not destroy the structural integrity of the water-soluble envelope. For the purposes of the present invention, the washing or cleaning agent preferably additionally contains one or more substances from the group of builders, bleaching agents, enzymes, pH adjusting agents, perfumes, perfume carriers, fluorescent agents, dyes, hydrotropes, foam inhibitors, silicone oils, antiredeposition agents, graying inhibitors, shrinkage prevention agents, anticrease agents, dye transfer inhibitors, antimicrobial active substances, non-aqueous solvents, germicides, fungicides, antioxidants, preservatives, corrosion inhibitors, antistatic agents, bitter agents, ironing aids, waterproofing and impregnation agents, skin-conditioning active substances, antiswelling and antislip agents, softening components and UV absorbers.

The liquid washing or cleaning agent preferably has an ionic strength $I_c$ of less than 250 mmol/l, more preferably less than 200 mmol/l and particularly preferably less than 150 mmol/l. The ionic strength I of a solution is a measure of the electrical field strength due to dissolved ions. Ionic strength I may be defined both in terms of the molarity c and in terms of the molality b of the dissolved ions as follows:

$$I_c = \frac{1}{2} \cdot \sum_i c_i \cdot z_i^2$$

$$I_b = \frac{1}{2} \cdot \sum_i b_i \cdot z_i^2$$

with $c_1$=molarity of the ionic species i (in mol/l)

$b_1$=molality of the ionic species i (in mol/kg)

$z_1$=charge number of the ionic species i $I_c$ or $I_b$: ionic strength of the solution relative to molarity or molality respectively It has been found that increasing the ionic strength $I_c$ to 250 mol/l and above, for example by adding inorganic salts, in order to bind free water, can resulting in salting out of ingredients of the washing or cleaning agent and/or to deposits on the water-soluble envelope.

For this reason it may be preferred for the liquid washing or cleaning agent to contain no added inorganic salts.

It is furthermore preferred for the quantity of aerobically non-biodegradable organic (aNBO) ingredients in the washing or cleaning agent to amount to less than 0.55 g per kg of laundry load.

It is likewise preferred for the quantity of anaerobically non-biodegradable organic (anNBO) ingredients in the washing or cleaning agent to amount to less than 0.70 g per kg of laundry load, A laundry load corresponds to dispensing 35 g of washing or cleaning agent onto 4.5 kg of laundry.

The liquid washing or cleaning agent is located in a water-soluble envelope.

In addition to the liquid washing or cleaning agent, a water-soluble package contains a water-soluble envelope. The water-soluble envelope is preferably formed by a water-soluble film material.

Such water-soluble packages may be produced by either vertical form fill sealing (VFFS) methods or thermoforming methods.

Thermoforming generally includes forming a first layer of a water-soluble film material to produce indentations for receiving a composition, introducing the composition into the indentations, covering the indentations filled with the composition with a second layer of a water-soluble film material and sealing the first and second layers together at least around the indentations.

The water-soluble envelope is preferably made of a water-soluble film material selected from the group comprising polymers or polymer blends. The envelope may be formed of one or of two or more layers of the water-soluble film material. The water-soluble film material of the first layer and further layers, if present, may be identical or different.

It is preferred for the water-soluble envelope to contain polyvinyl alcohol or a polyvinyl alcohol copolymer.

Suitable water-soluble films for producing the water-soluble envelope are preferably based on a polyvinyl alcohol or a polyvinyl alcohol copolymer, the molecular weight of which is in the range from 10,000 to 1,000,000 $gmol^{-1}$, preferably from 20,000 to 500,000 $gmol^{-1}$, more preferably from 30,000 to 100,000 $gmol^{-1}$ and in particular from 40,000 to 80,000 $gmol^{-1}$.

Polyvinyl alcohol is conventionally produced by hydrolysis of polyvinyl acetate, since the direct synthetic pathway is not possible. The same is true of polyvinyl alcohol copolymers, which are accordingly produced from polyvinyl acetate copolymers. It is preferred for at least one layer of the water-soluble envelope to comprise a polyvinyl alcohol having a degree of hydrolysis of 70 to 100 mol %, preferably of 80 to 90 mol %, more preferably of 81 to 89 mol % and in particular of 82 to 88 mol %.

A polymer selected from the group comprising (meth) acrylic acid-containing (co)polymers, polyacrylamides, oxazoline polymers, polystyrenesulfonates, polyurethanes, polyesters, polyethers, polylactic acids or mixtures of the above polymers may additionally be added to a polyvinyl alcohol-containing film material suitable for producing the water-soluble envelope. Polylactic acids are a preferred additional polymer.

In addition to vinyl alcohol, preferred polyvinyl alcohol copolymers comprise dicarboxylic acids as further monomers. Suitable dicarboxylic acids are itaconic acid, malonic acid, succinic acid and mixtures thereof, wherein itaconic acid is preferred.

In addition to vinyl alcohol, likewise preferred polyvinyl alcohol copolymers comprise an ethylenically unsaturated carboxylic acid, the salt thereof or the ester thereof. In addition to vinyl alcohol, such polyvinyl alcohol copolymers more preferably contain acrylic acid, methacrylic acid, acrylic acid esters, methacrylic acid esters or mixtures thereof.

It may be preferred for the film material to contain further additives. The film material may for example contain plasticizers such as dipropylene glycol, ethylene glycol, diethylene glycol, propylene glycol, glycerol, sorbitol, mannitol or mixtures thereof. Further additives comprise for example release aids, fillers, crosslinking agents, surfactants, antioxidants, UV absorbers, antiblocking agents, non-stick agents or mixtures thereof.

Suitable water-soluble films for use in the water-soluble envelopes of the water-soluble packages according to the invention are films which are distributed for example by MonoSol LLC for example under the names M8630, M8310, C8400 or M8900. Other suitable films comprise films known as Solublon® PT, Solublon® GA, Solublon® KC or Solublon® KL from Aicello Chemical Europe GmbH or VF-HP films from Kuraray.

In a preferred embodiment, the water-soluble package has one chamber for accommodating the liquid washing or cleaning agent.

In a further, likewise preferred embodiment, the water-soluble package has two chambers. In this embodiment, the first chamber contains the above-described liquid washing or cleaning agent and the second chamber may contain a solid or a liquid washing or cleaning agent.

If the water-soluble package has three chambers, these chambers may all in each case contain a liquid washing or cleaning agent. It is, however, also possible for one chamber to contain a solid washing or cleaning agent and two chambers to contain a liquid washing or cleaning agent. It is moreover possible for two chambers to contain a solid washing or cleaning agent and one chamber to contain a liquid washing or cleaning agent.

In water-soluble packages with four or more chambers, there are correspondingly still more possible combinations with regard to the number of chambers with a solid or a liquid washing or cleaning agent.

In water-soluble packages with two or more chambers, at least one of the chambers contains the above-described liquid washing or cleaning agent according to the invention solely comprising surfactants which are obtained from renewable raw materials. The liquid washing or cleaning agents which are present in the other chambers of a water-soluble package may have the same composition. The liquid washing or cleaning agents in a water-soluble package with at least two chambers preferably have compositions which differ with regard at least to the content of an ingredient.

The quantity of washing or cleaning agents located in total in the water-soluble package preferably correspond to the entire dose or half the dose which is required for a washing cycle.

EXAMPLES

Liquid washing or cleaning agents were produced using conventional, known procedures and methods. Table 1 below shows the compositions of two washing or cleaning agents according to the invention (Inv. 1 and Inv. 2) and four washing or cleaning agents not according to the invention (Comp. 1 to Comp. 4).

Table 1: Liquid washing or cleaning agents Inv. 1 and Inv. 2 and Comp. 1 to Comp. 4 [all quantities are stated in wt. % of active substance, relative to the composition]

| Ingredients | Inv. 1 | Inv. 2 | Comp. 1 | Comp. 2 | Comp. 3 | Comp. 4 |
|---|---|---|---|---|---|---|
| Na lauryl ether sulfate (2EO) | 12 | 12 | 12 | 12 | 12 | 12 |
| $C_{12-18}$ fatty alcohol with 7 EO | 25 | 25 | 25 | 25 | 25 | 25 |
| $C_{12-18}$ fatty acid | 15 | 15 | 15 | 15 | 15 | 15 |
| Ethanol | 1.4 | 1.4 | — | — | — | — |
| Isopropanol | — | — | 1.4 | 1.4 | 1.4 | 1.4 |
| Phosphonate | 1 | 1 | 1 | 1 | 1 | 1 |
| Monoethanolamine | 3.86 | 3.86 | 3.94 | 3.67 | 3.71 | 3.91 |
| Citric acid, sodium salt | — | — | — | 1.4 | 2.25 | — |
| $MgCl_2 \bullet 6H_20$ | — | — | — | — | — | 1.4 |
| Dyes, enzymes (cellulase, amylase | 0.8 | 0.8 | 0.8 | 0.8 | 0.8 | 0.8 |
| & protease), perfume | — | — | — | — | — | — |
| Optical brightener | 0.1 | — | 0.1 | 0.1 | 0.1 | 0.1 |
| Water | 2 | 2 | 2 | 2 | 2 | 2 |
| 1,2-Propanediol | to 100 | to 100 | to 100 | to 100 | to 100 | to 100 |

The ionic strength $I_c$ of the liquid washing or cleaning agents Inv. 1 and Inv. 2 was in each case less than 150 mmol/l. The quantity of aerobically non-biodegradable organic (aNBO) ingredients in the washing or cleaning agents Inv. 1 and Inv. 2 was in each case 0.13 g per kg of laundry load. The quantity of anaerobically non-biodegradable organic (anNBO) ingredients in the washing or cleaning agents Inv. 1 and Inv. 2 was in each case 0.14 g per kg of laundry load. The water activity $a_w$ of the liquid washing or cleaning agents Inv. 1 and Inv. 2 was in each case 0.45.

To produce water-soluble packages containing the washing or cleaning agents Inv. 1 and Inv. 2 and Comp. 1 to Comp. 4, an M 8630 grade film (from Monosol) with a thickness of 76 μm was drawn by vacuum into a depression to form an indentation. The indentation was then filled with 30 ml of one of the liquid washing or cleaning agents Inv. 1, Inv. 2 or Comp. 1 to Comp. 4. After covering the indentations filled with the agent with a second layer of an M 8630 grade film, the first and second layers were sealed together. The sealing temperature was 150° C. and the sealing duration was 1.1 seconds.

After 4, 8 and 12 weeks' storage of the water-soluble packages containing the washing or cleaning agents Inv. 1 or Inv. 2 under different climatic conditions, no partial or complete dissolution of the water-soluble envelope could be observed. In addition, no pores or holes which would likewise result in product escaping or leaking out could be identified.

Water-soluble packages containing the liquid washing or cleaning agents Inv. 1 and Inv. 2 dissolved without residue in washing cycles at temperatures in the range from 20 to 95° C. and, in comparison with a water-soluble package containing a liquid washing or cleaning agent which contained $C_{12-18}$ fatty acid soap, $C_{12-18}$ fatty alcohol with 7 EO and a $C_{9-13}$ alkylbenzenesulfonate as surfactant system, exhibited equally good cleaning performance.

In water-soluble packages containing the liquid washing or cleaning agents Comp. 2 to Comp. 4, severe sedimentation was evident after just one day. The liquid washing or cleaning agent Comp. 1 gelled during storage in the water-soluble package. Moreover, liquid escaped through the water-soluble envelope onto the surface of the water-soluble package.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A water-soluble package which comprises a liquid washing or cleaning agent and a water-soluble envelope, wherein the liquid washing or cleaning agent comprises:

a) nonionic surfactant selected from the group consisting of alkoxylated fatty alcohols, alkyl polyglycosides, ethoxylated methyl esters of natural fatty acids and mixtures thereof, b) anionic surfactants selected from the group consisting of sulfonated estolides, c) organic solvent which comprises a mixture of from 10 to 40 wt. % 1,2-propanediol and from 1 to 3% wt. % ethanol, in each case relative to the entire washing or cleaning agent, and d) from 7 to 12 wt. %, relative to the entire washing or cleaning agent, of water, wherein the surfactants in the liquid washing or cleaning agent are obtained from renewable raw materials, and wherein the quantity of aerobically non-biodegradable organic (aNBO) ingredients in the washing or cleaning agent amounts to less than 0.55 g per kg of laundry load and the quantity of anaerobically non-biodegradable organic (anNBO) ingredients in the washing or cleaning agent amounts to less than 0.70 g per kg of laundry load.

2. The water-soluble package according to claim 1, wherein the ionic strength Ic of the washing or cleaning agent is less than 250 mmol/l.

3. The water-soluble package according to claim 1, wherein the liquid washing or cleaning agent comprises at least 5 wt. % of fatty alcohol ether sulfate.

4. The water-soluble package according to claim 1, wherein the washing or cleaning agent has a water activity aw of ≥0.38.

5. The water-soluble package according to claim 1, wherein the water-soluble envelope comprises polyvinyl alcohol or a polyvinyl alcohol copolymer.

* * * * *